US006652389B2

(12) United States Patent
Hisamatsu et al.

(10) Patent No.: US 6,652,389 B2
(45) Date of Patent: Nov. 25, 2003

(54) GOLF CLUB SHAFT

(75) Inventors: Goro Hisamatsu, Gifu (JP); Hiroki Ashida, Gifu (JP); Yasushi Matsui, Gifu (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/998,925

(22) Filed: Nov. 30, 2001

(65) Prior Publication Data

US 2002/0115500 A1 Aug. 22, 2002

(30) Foreign Application Priority Data

Dec. 1, 2000 (JP) ..... 2000-366594

(51) Int. Cl.[7] ..... A63B 53/10
(52) U.S. Cl. ..... 473/319
(58) Field of Search ..... 473/316–323, 473/287

(56) References Cited

U.S. PATENT DOCUMENTS 4,725,062 A * 2/1988 Kinney, III ..... 473/330
5,653,646 A * 8/1997 Negishi et al. ..... 473/319
5,979,288 A * 11/1999 Gallagher et al. ..... 87/36
6,117,021 A * 9/2000 Crow et al. ..... 473/289

FOREIGN PATENT DOCUMENTS

JP 8-38659 * 2/1996
JP 11-99229 * 4/1999

* cited by examiner

*Primary Examiner*—Stephen Blau
(74) *Attorney, Agent, or Firm*—Troutman Sanders LLP; Gerald R. Boss

(57) ABSTRACT

The golf club shaft comprises a reinforced tip portion from the tip end to the position 300 mm toward the grip end, gripping butt portion from the grip end to the position 100 mm toward the tip end, and an intermediate portion between the reinforced tip portion and the gripping butt portion. The shaft satisfies an equation $EI=\alpha \cdot X$ at its intermediate portion, where EI ($Nm^2$) is the flexural rigidity, X (mm) is the distance from the tip end of the shaft, and $\alpha$ is a given constant. The $\alpha$ values of the shafts in accordance with the embodiments 1 through 3 are 0.12, 0.09, and 0.06, respectively. Thus, the present invention has an improved deflection during downswing and is liked by a majority of players.

13 Claims, 19 Drawing Sheets

GOLF CLUB SHAFT

This patent application claims priority to Japanese Patent Application No. 2000-366594 dated Dec. 1, 2000 entitled "Golf Club Shaft."

BACKGROUND OF THE INVENTION

The present invention relates to a golf club shaft with improved feeling that is obtained by improving the uniformity of deflection of the golf club shaft during downswing.

Conventionally, in terms of flexural rigidity (EI) of the shaft, the characteristics of the wood-type golf club are generally expressed as 'tip kick point,' 'mid kick point,' and 'butt kick point.'

Specifically, EI is made lower in a particular portion of the conventional golf club shaft than in the remaining portions (or made higher in the remaining portions) to decrease the deflection radius of curvature of the particular portion and to adjust the flex of the shaft during a swing.

The shaft of the 'tip kick point' type refers to a shaft with a lower EI value near the tip portion of the golf club shaft. The 'tip kick point' type shaft usually generates a greater launching angle of the ball and is considered to be suitable for beginners. The 'butt kick point' type shaft refers to a shaft with a lower EI value near the grip side, as compared with the 'tip kick point' type shaft. The 'butt kick point' type shaft suppresses launching of the ball and is considered suitable for advanced players. The shaft between the both types is the 'mid kick point' type shaft.

FIG. 1 is a graph showing the EI values of the conventional golf club shafts. The conventional shafts 1, 2, and 3 are the 'butt kick point' shaft, the 'tip kick point' shaft, and the 'mid kick point' shaft, respectively. The axis of abscissas shows the distance from the tip end in the longitudinal direction. The conventional golf club shafts are generally constructed as shown in the graph.

The 'tip kick point' shaft (conventional shaft 2) has a long portion with a low EI value at the tip portion. The EI value drastically increases therefrom toward the grip portion. The 'butt kick point' shaft (conventional shaft 1) has low rate of increase of the EI value from the tip portion to the butt portion, resulting in a low EI value at the butt portion. The 'mid kick point' shaft (conventional shaft 3) has a higher EI value at the tip and butt portions and a lower EI value at the mid portion. The EI value of the shaft greatly varies according to the kick point.

No specific definition has been established for the EI distribution of the kick points of the golf club shaft. The kick points have been mainly determined by design concepts of respective manufacturers. The performance of the golf club shaft may not be properly evaluated according to the designated kick points. For example, no more definite correlation exists between the launching angle of the hit ball and the EI value at the tip portion versus at other portions. Different players like different kick points, whether they are beginners or advanced players. Thus, the EI distribution liked by a majority of players has not been yet established, in spite of struggling efforts by manufacturers.

It is an object of the present invention to provide a golf club shaft having a shaft's EI distribution liked by every player by improving the deflection shape of the golf club shaft during a swing.

BRIEF SUMMARY OF THE INVENTION

A golf club shaft comprises a reinforced tip portion including a tip end, a gripping butt portion including a grip end, an intermediate portion between the reinforced tip portion and the gripping butt portion. The flexural rigidity and the distance from the tip end are in substantially direct proportion generally over the entire length of the intermediate portion.

Other aspects and advantages of the invention will become apparent from the following description, taken in conjunction with the accompanying drawings, illustrating by way of example the principles of the invention.

BRIEF DESCRIPTION OF THE SEVERAL VIEWS OF THE DRAWING

The invention, together with objects and advantages thereof, may best be understood by reference to the following description of the presently preferred embodiment together with the accompanying drawings in which.

DETAILED DESCRIPTION OF THE PREFERRED EMBODIMENTS

Figure 2:
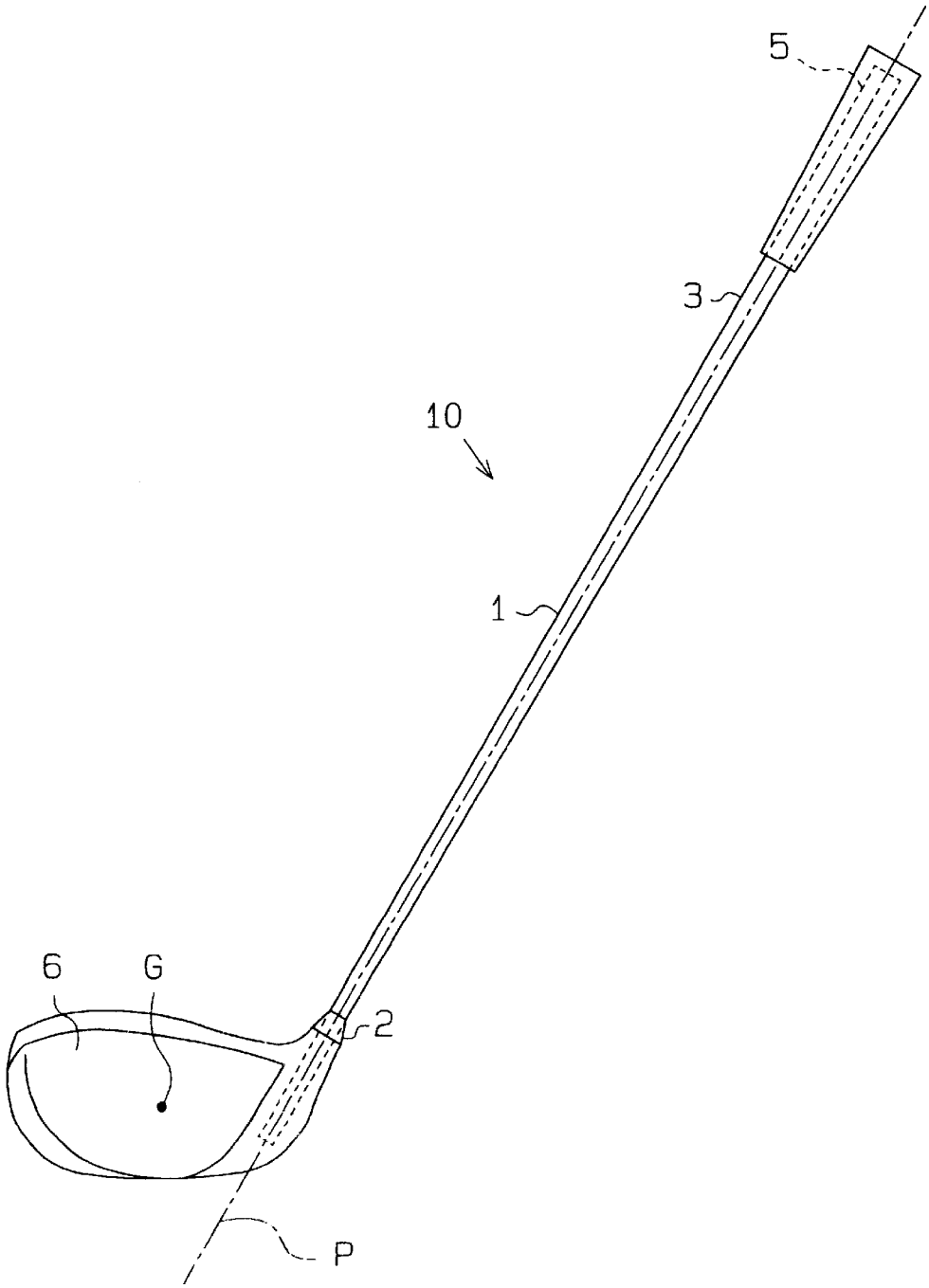
FIG. 2 is a schematic view of a golf club.

With reference to FIG. 2, a golf club 10 having a golf club shaft 1 is shown. The inventors attempted to determine how the shaft 1 deforms while the club 10 is swung. Several existing golf clubs were selected to measure the bending moment M applied to the shaft 1 during downswing of the clubs. Once the distributions of the bending moment M and of the flexural rigidity EI are obtained, the distribution of the deflection radius of curvature ρ (m) may be calculated by dividing the flexural rigidity EI by the bending moment M.

$$\rho = EI/M \qquad \text{Equation (1)}$$

The distribution of the bending moment M was measured as described below.

A driver (1W), No. 3 iron (3I), No. 6 iron (6I), and No. 9 iron (9I) were selected from among ordinary golf clubs with their distribution of the shaft bending moment EI already known. Strain gauges were respectively attached at four locations on the golf club shaft 1, as shown in Table 1. Each of three subjects A, B, and C swung the four golf clubs. The quantity of strain at the four locations was measured with the strain gauges during the time from head turn (i) to the impact (vii) shown in the conceptual diagram of the swing in FIG. 3.

As shown in FIG. 2, the shaft 1 is mounted to the head 6 so that the tip end 4 of the shaft 1 comes to the position a given amount on the grip side from the perpendicular projection point of the gravitational center G of the head on the shaft axis P. In a 1W club this amount is 30 mm, and in a 3I, 6I, and 9I club it is 20 mm.

TABLE 1

| Club No. | Length of club (mm) | Position of strain gauge (from tip end) (mm) | | | |
|---|---|---|---|---|---|
| 1W | 1,118 | 98 | 328 | 578 | 828 |
| 3I | 992 | 102 | 292 | 502 | 702 |
| 6I | 959 | 104 | 289 | 474 | 659 |
| 9I | 922 | 97 | 262 | 447 | 622 |

The bending moment was calculated from the quantity of strain by using the equation below:

$$M = (\epsilon/d) \times EI \qquad \text{Equation 2}$$

where M is bending moment (Nm), d is external diameter of the cross section (m), ϵ is the quantity of strain (–), and EI is flexural rigidity ($Nm^2$)

FIGS. 4 through 15 are graphs showing the calculated bending moment M for each subject and each club 0.15 (–0.15 s), 0.20 (–0.2 s), 0.25 (–0.25 s), 0.30 (–0.3 s), 0.35 (–0.35 s), and 0.40 (–0.4 s), seconds before the impact. The axis of abscissas is the distance from the tip end of the golf club shaft in the longitudinal direction.

The period between 0.40 (s) to 0.15 (s) before the impact corresponds to the period from the head turn of the swing (i) to the moment just before the cock opening (vi), and also corresponds to the downswing period, during which the angular speed of the subject's arms continues to increase.

After the downswing period, the angular speed of the subject's arms decreases, the cock opens, and the subject hits the ball (impact (vii)). Since the center of gravity of the head deviates from the trajectory of the golf club shaft at the time of cock opening just before the impact, complicated bending moment (including rotational moment of the head in the tow down direction) is applied to the shaft. Since such an application of the bending moment lasts only for a short period of time, such bending moment is ignored.

As shown in FIGS. 4 through 15, during the period between 0.40 (s) and 0.15 (s) before the impact, the bending moment M applied was proportional to the distance from the tip end 4 (direct-proportion bending moment), with the bending moment M at the tip end 4 set as zero. The distribution of the bending moment M is extremely simple and stably proportional in terms of time. The inclination of the bending moment M, however, significantly varies according to the subjects and time.

Figure 7:
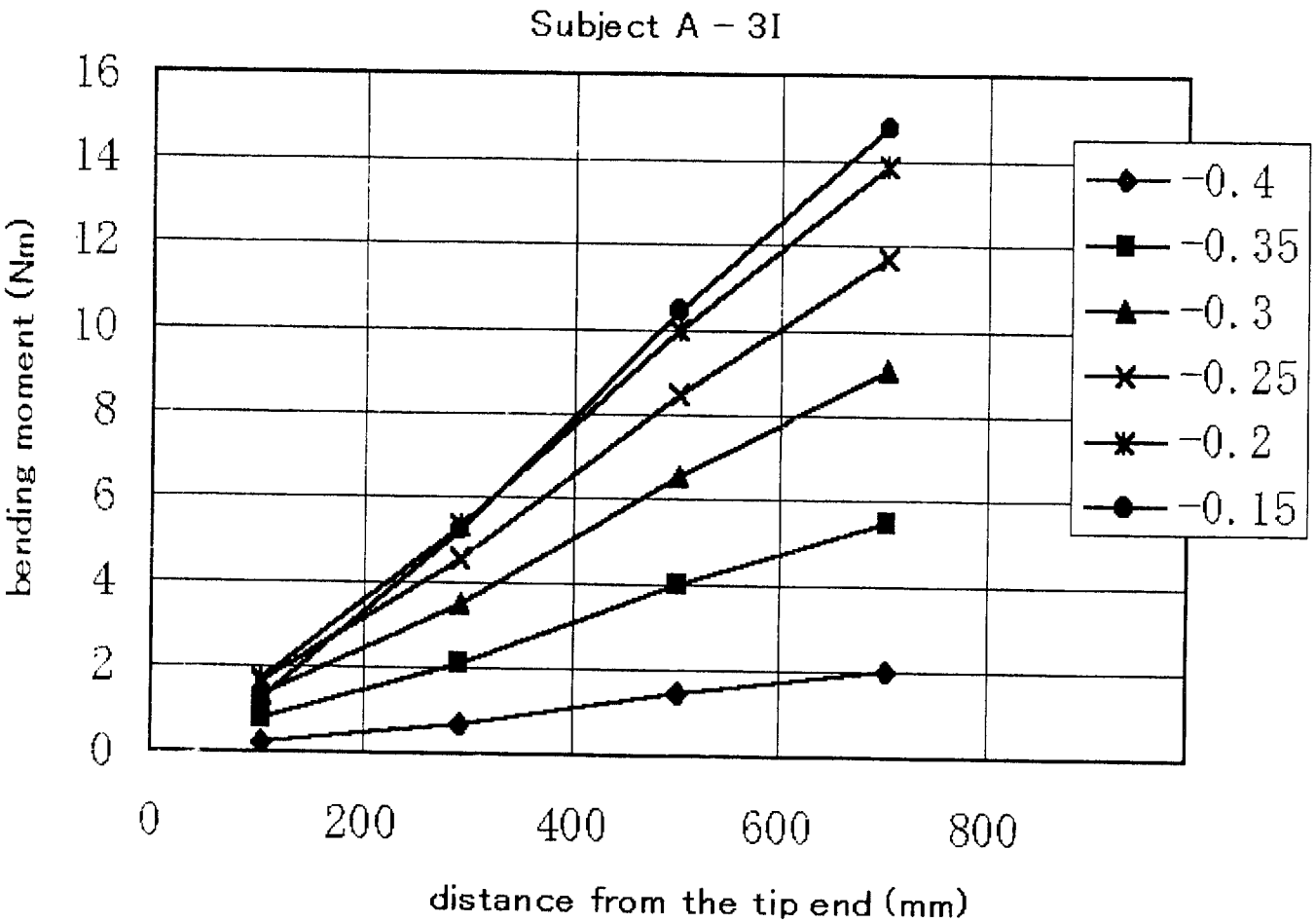
FIG. 7 is a graph showing the bending moment of the golf club shaft when the subject A swung a conventional No. 3 iron (3I).
Figure 8:
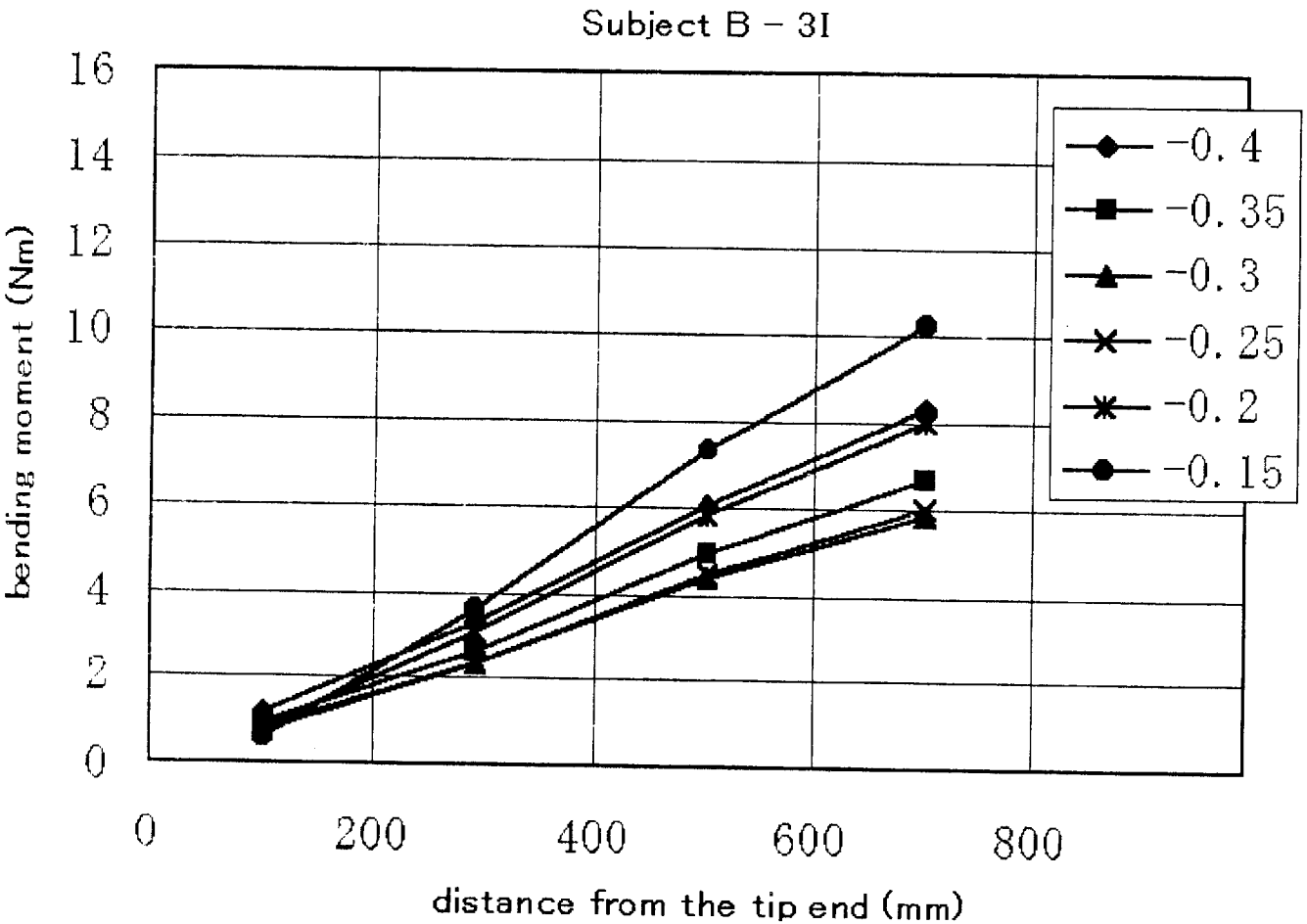
FIG. 8 is a graph showing the bending moment of the golf club shaft when the subject B swung a conventional No. 3 iron (3I).
Figure 9:
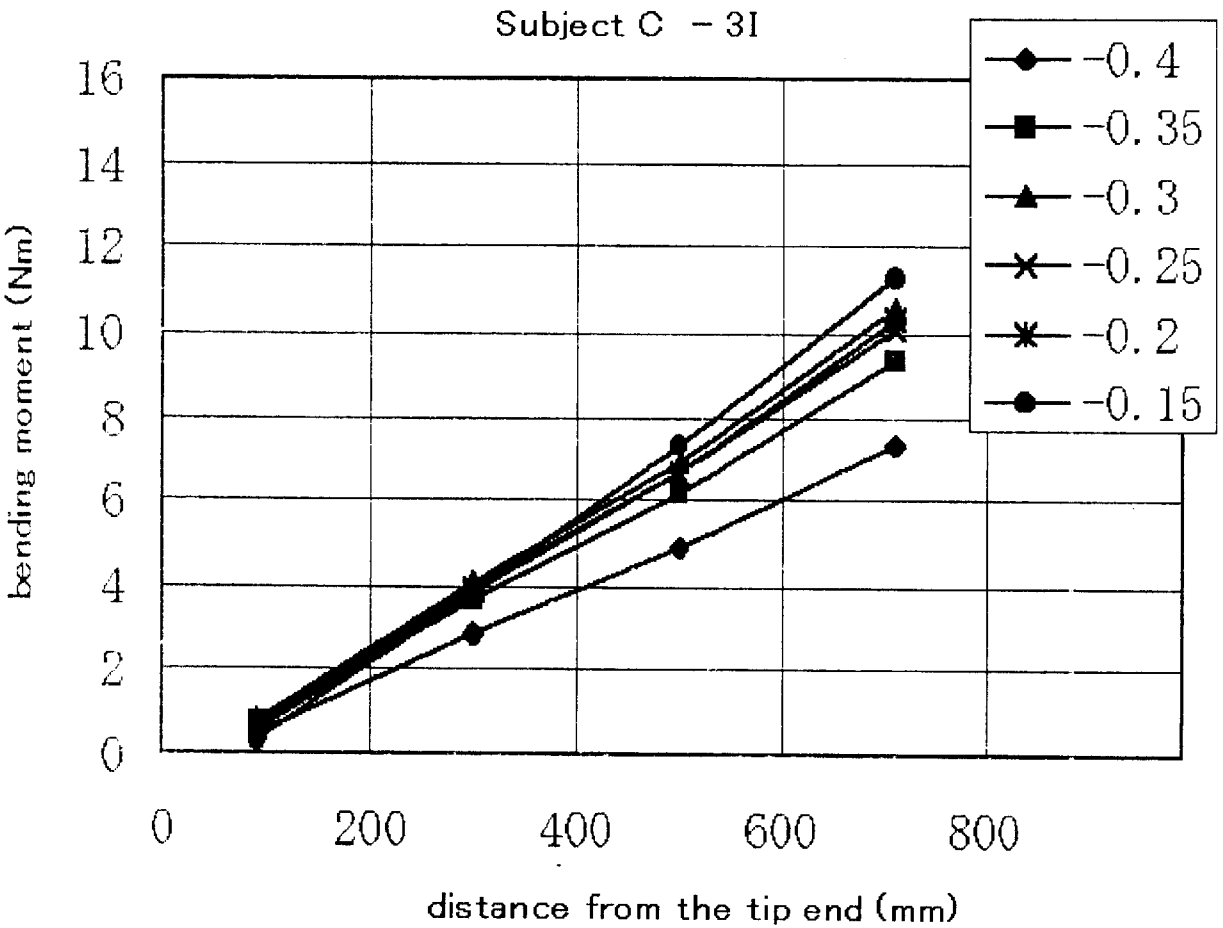
FIG. 9 is a graph showing the bending moment of the golf club shaft when the subject C swung a conventional No. 3 iron (3I).
Figure 10:
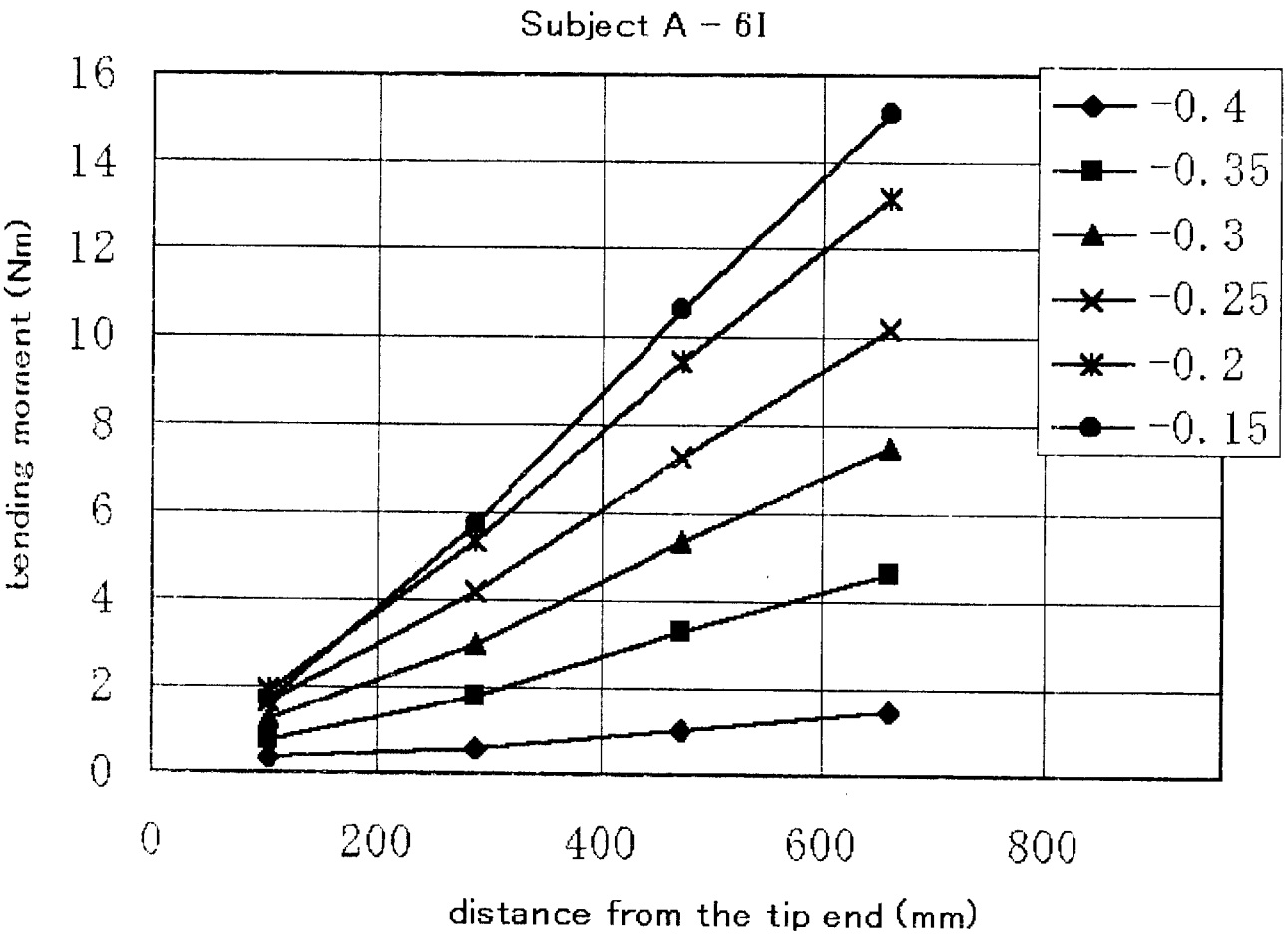
FIG. 10 is a graph showing the bending moment of the golf club shaft when the subject A swung a conventional No. 6 iron (6I).
Figure 11:
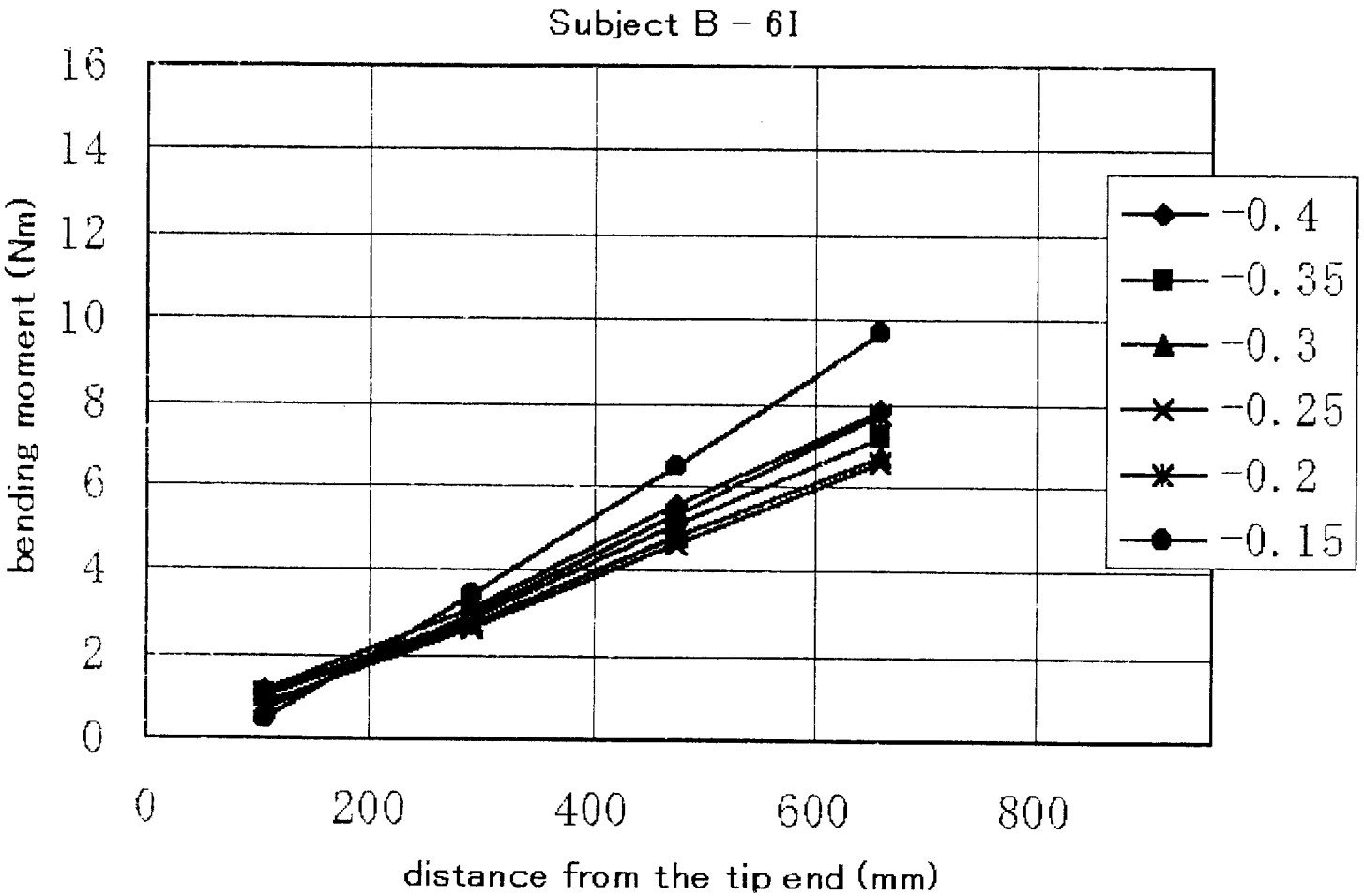
FIG. 11 is a graph showing the bending moment of the golf club shaft when the subject B swung a conventional No. 6 iron (6I).
Figure 12:
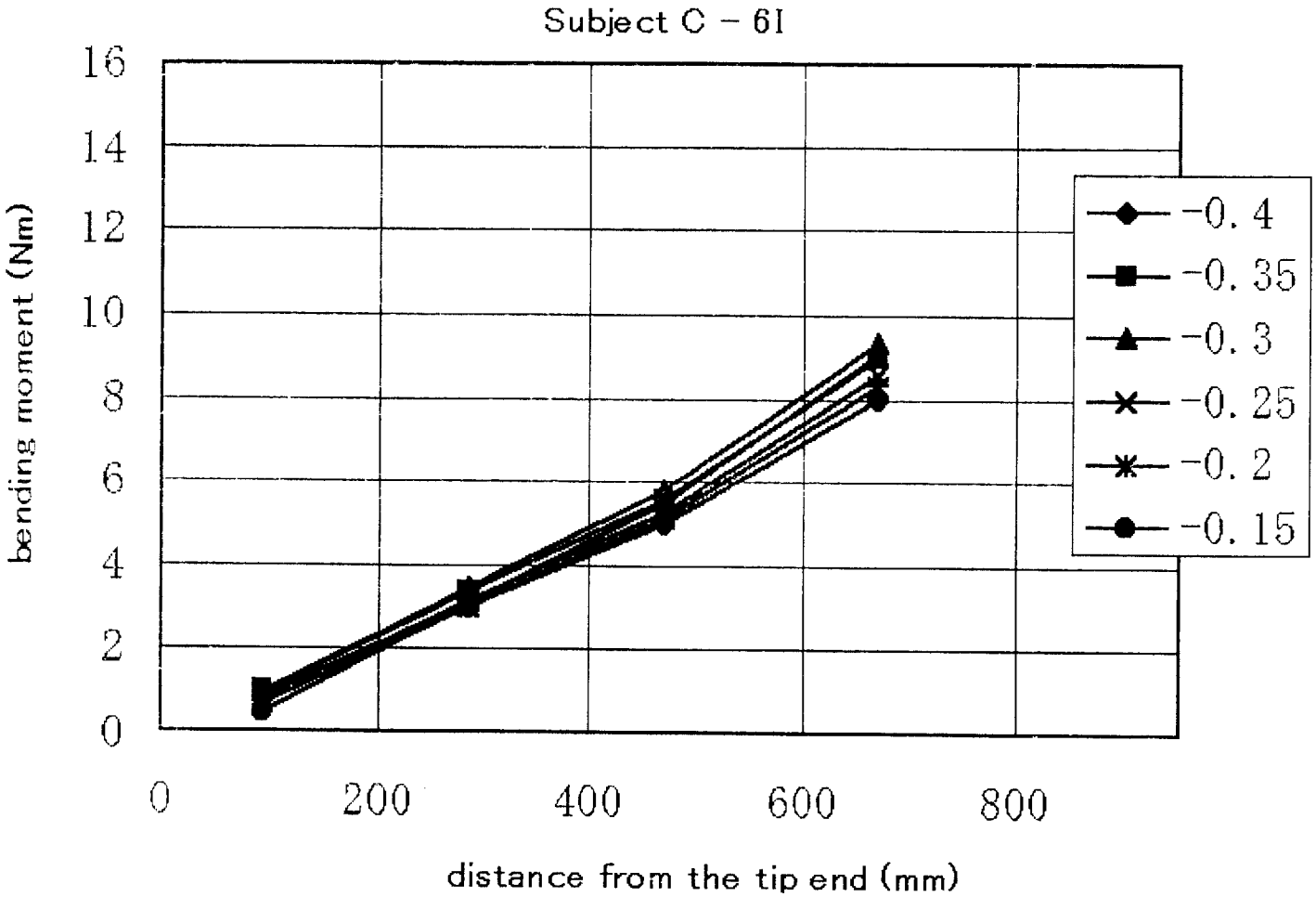
FIG. 12 is a graph showing the bending moment of the golf club shaft when the subject C swung a conventional No. 6 iron (6I).
Figure 13:
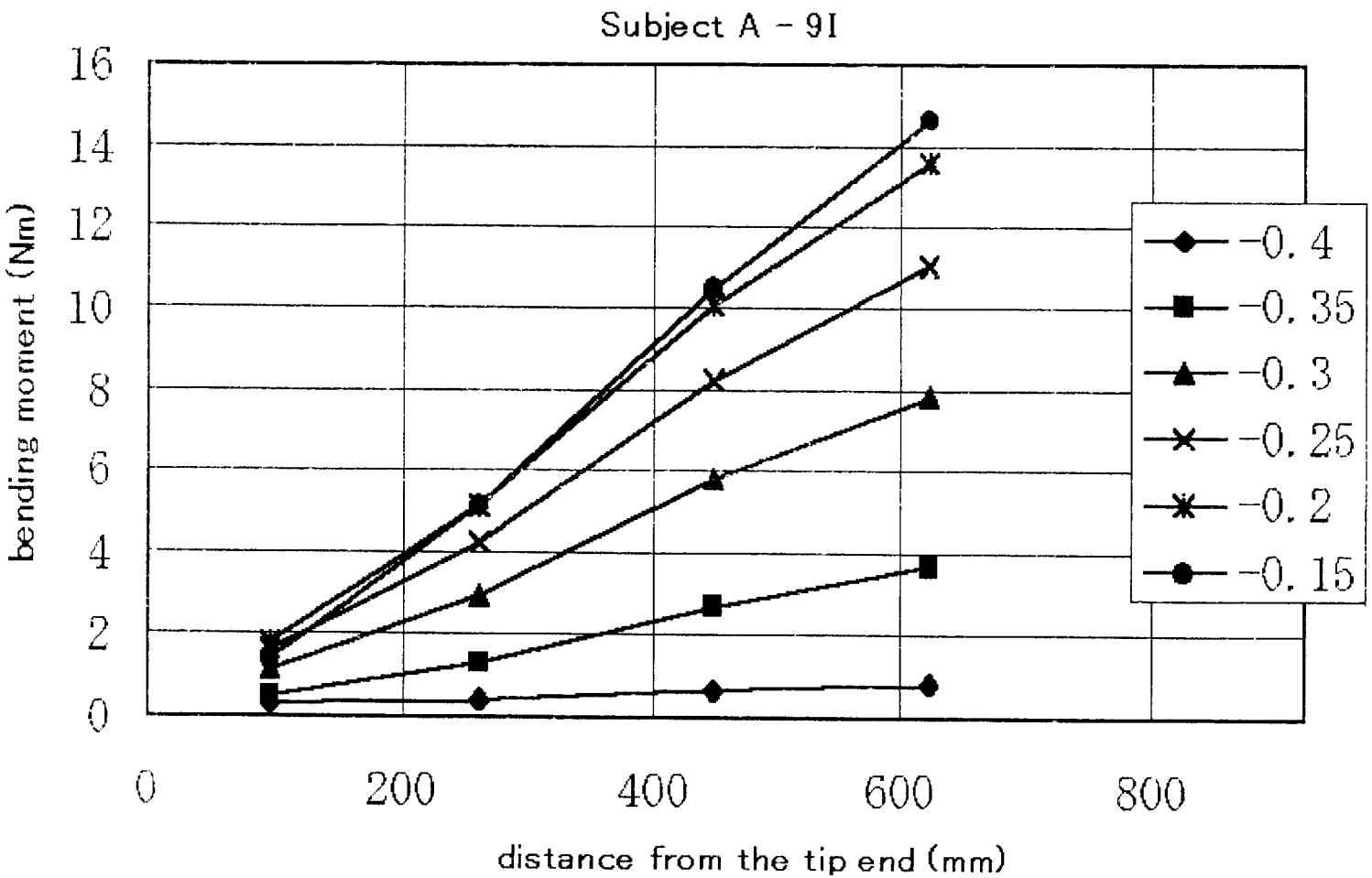
FIG. 13 is a graph showing the bending moment of the golf club shaft when the subject A swung a conventional No. 9 iron (9I).
Figure 14:
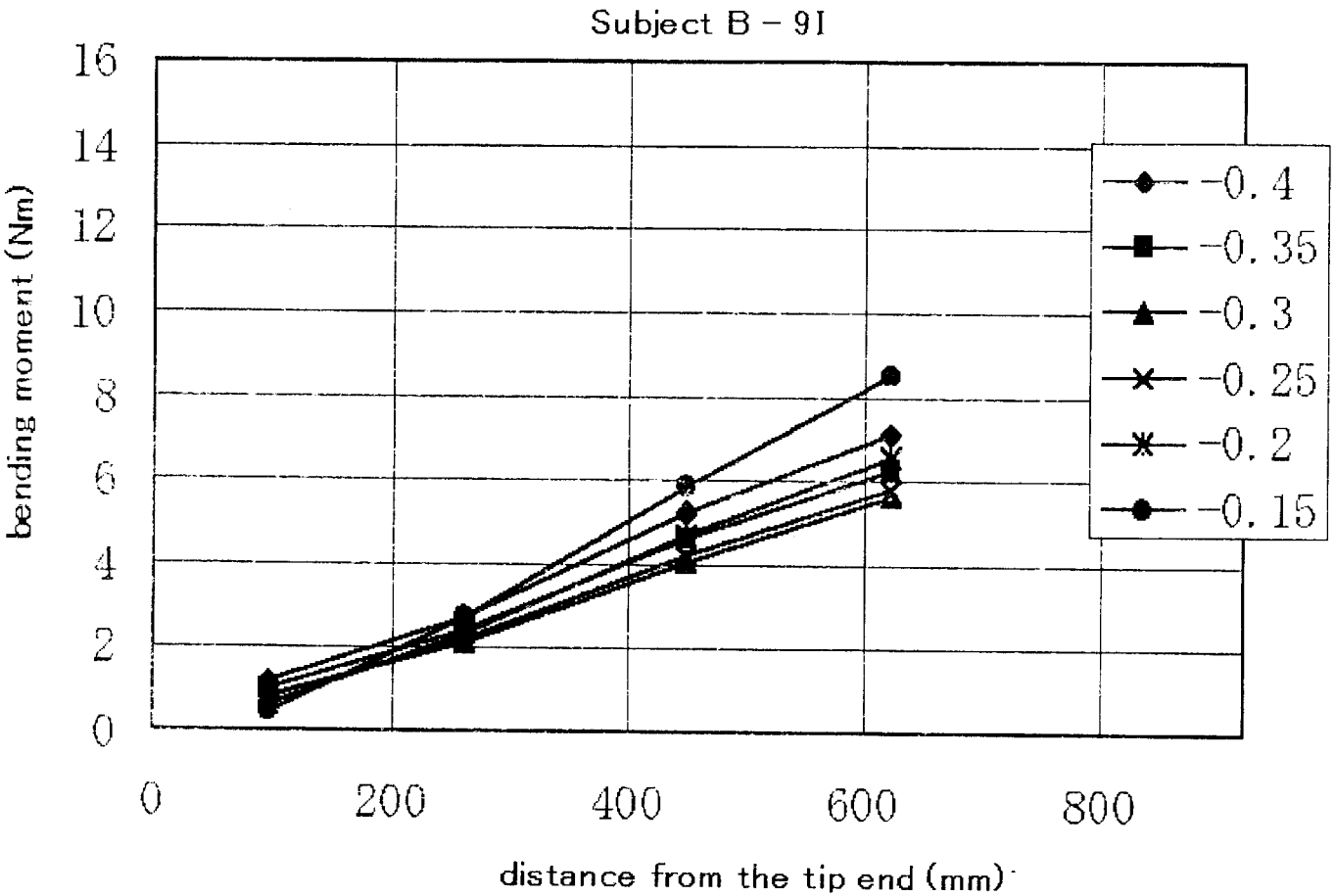
FIG. 14 is a graph showing the bending moment of the golf club shaft when the subject B swung a conventional No. 9 iron (9I).
Figure 15:
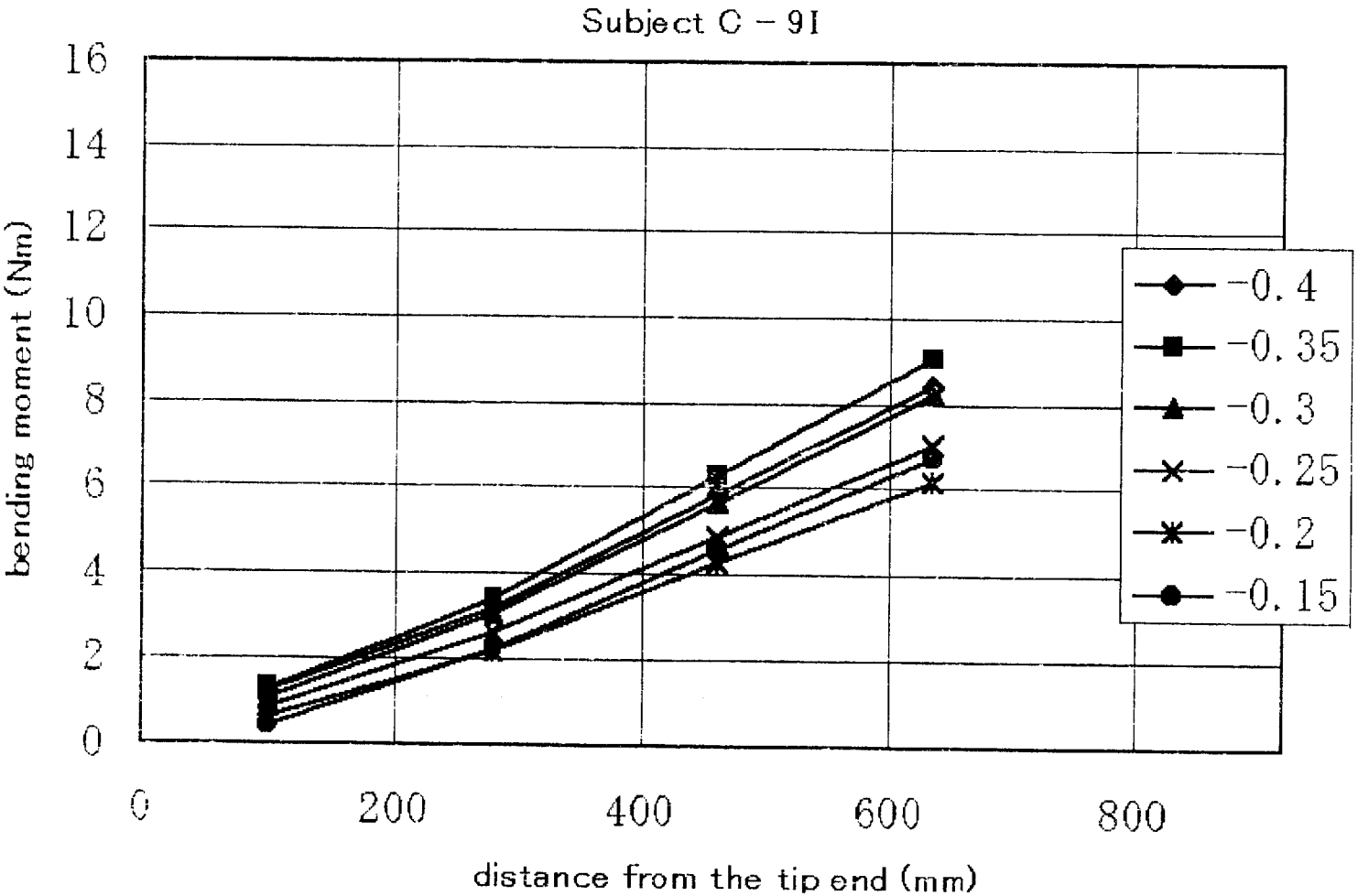
FIG. 15 is a graph showing the bending moment of the golf club shaft when the subject C swung a conventional No. 9 iron (9I).
Figure 16:
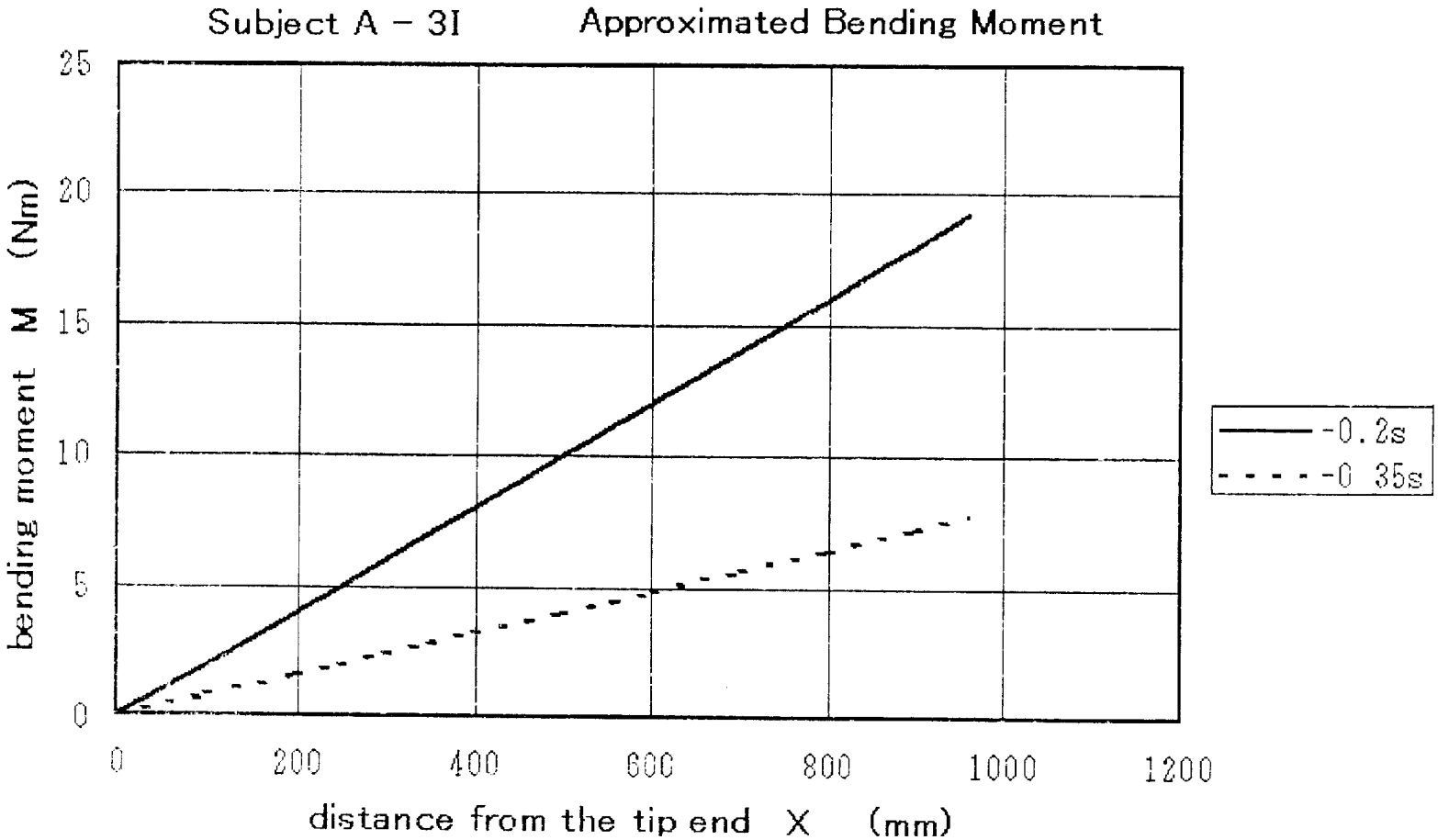
FIG. 16 is a graph showing the bending moment of the golf club shaft of FIG. 7 when the subject A swung the No. 3 iron (3I), with the bending moment linearly approximated in direct proportion to distance from the tip end.

Among the measurement results, the bending moment M obtained by the swing of the subject A of FIG. 7 (with shaft length of 960 mm) at 0.2 (s) and 0.35 (s) before the impact is shown in a graph approximating a direct proportionality between bending moment and distance from the tip end as a typical example of the direct proportional bending moment in FIG. 16.

In FIG. 16, the axis of ordinates is the bending moment M (Nm), and the axis of abscissas is the distance X (mm) from the tip end 4. The two graphs in FIG. 16 are represented by M=0.020X (–0.2 s) and M=0.008X (–0.35 s), respectively.

Figure 1:
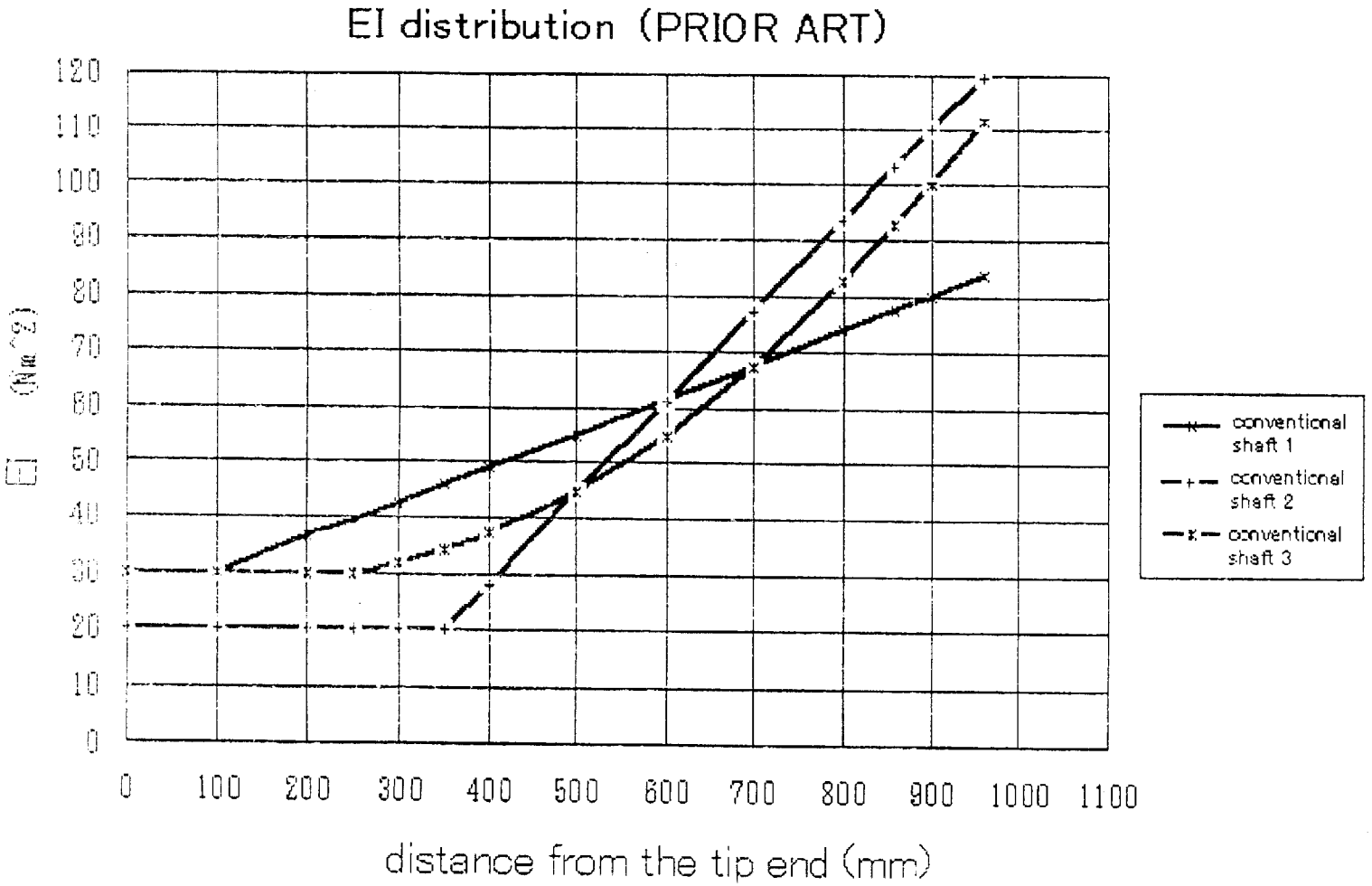
FIG. 1 is a graph showing the EI distribution of the conventional golf club shafts.

When a typical large bending moment and a typical small bending moment are M=0.020X and M=0.008X, respectively, and the above-mentioned direct-proportion bending moment M is applied to the conventional shafts 1 through 3 of FIG. 1 with their distribution of flexural rigidity EI already known, the deflection radius of curvature ρ (m) of the shaft is obtained from the hereinbefore-mentioned equation 1. The result is shown in FIG. 17 with the length of the golf club shaft set on the axis of abscissas.

Figure 17:
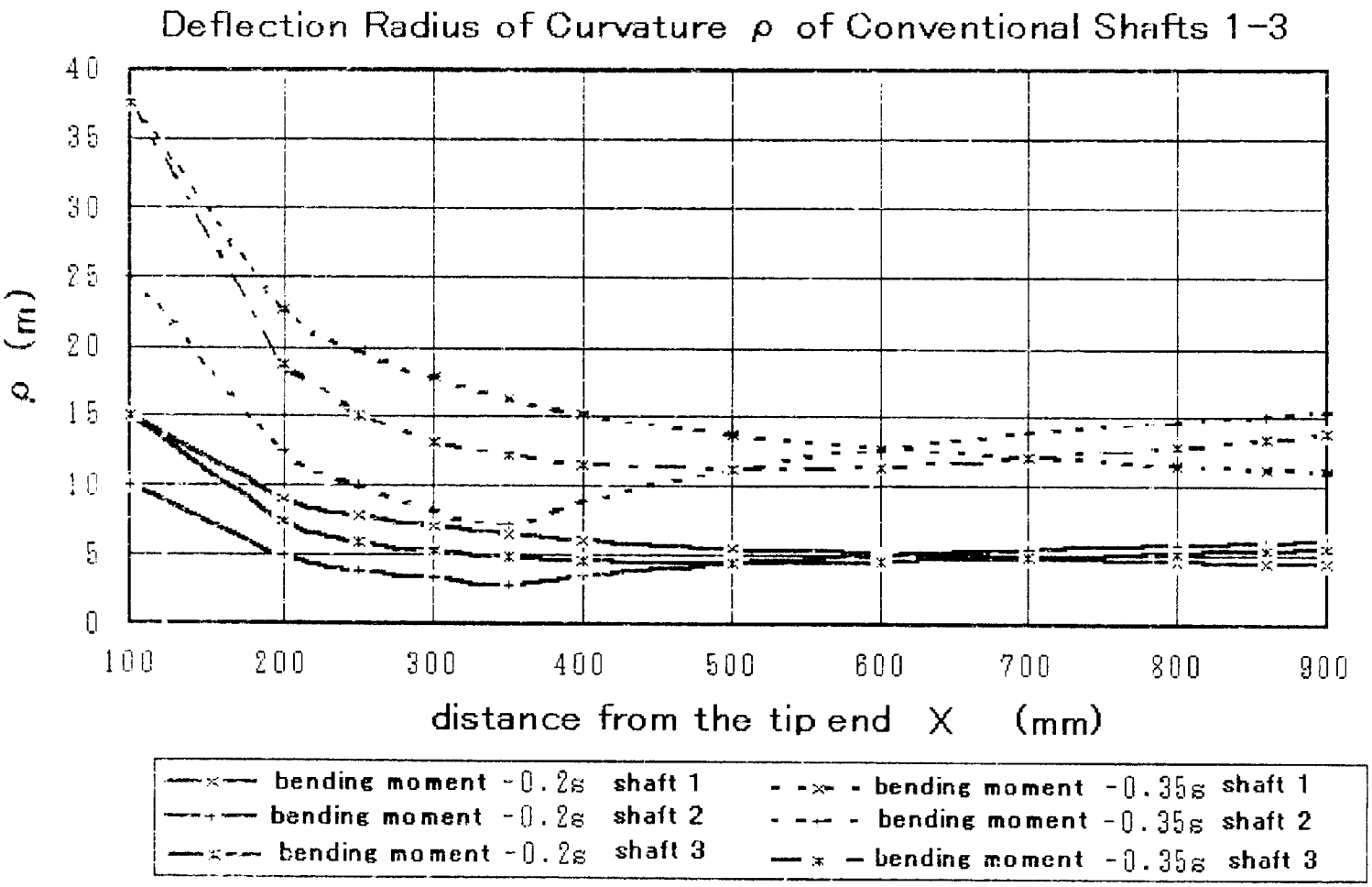
FIG. 17 is a graph showing the deflection radius of curvature of the golf club shaft when a direct-proportion bending moment, in relation to distance from the tip end, is applied to the conventional golf club shaft.

As shown in FIG. 17, the deflection radius of curvature ρ of the conventional shafts 1 through 3 changed greatly throughout their entire length, both at 0.2 seconds before the impact (in solid line) and at 0.35 seconds before the impact (in dotted line).

The "reinforced tip portion" (numeral 2 in FIG. 2) is a portion of the shaft that is reinforced by increasing carbon fibers to prevent breakage due to the impact. The reinforcement is generally applied in a range from the shaft tip end to 300 mm from the tip end although the range varies on factors such as a head shape and a head mass. This reinforced tip portion has an exceptionally great deflection radius of curvature ρ. The conventional club 2 (the "tip kick point" shaft) has a large variation in deflection radius of curvature ρ in the intermediate portion (the portion of the shaft between the reinforced tip portion and the grip) at the bending moment 0.2 seconds before the impact. The ρ value at the 900 mm from the tip end 4 is approximately 2.2 times the value ρ at the position 350 mm from the tip end 4. In other words, the deflection shape of the shaft is not uniform.

The present inventors considered this distortion makes the conventional clubs 1 through 3 unacceptable to most players, but found that a constant deflection radius of curvature ρ over the entire length of the golf club shaft 1 makes a universal golf club shaft, liked by a majority of players.

The bending moment M applied to the golf club shaft during downswing is directly proportional to the distance from the tip end 4, as shown in the results of the above preliminary test. Therefore, the deflection radius of curvature ρ may be maintained at a constant level simply by maintaining the EI distribution so that EI is directly proportional to the distance from the tip end 4.

The distribution of the flexural rigidity EI of the shaft cannot change with time. Therefore, if the distribution of the bending moment M deviates during downswing from a direct proportionality with distance from the tip end and shifts to other types of distribution, the deflection radius of curvature ρ will not stay constant Therefore, even when the distribution of the flexural rigidity EI is in direct proportional relationship with respect to distance from the tip end, the deflection radius of curvature ρ remains constant during a particular period in downswing (when the M is directly proportional to the distance from the tip end), but it cannot be maintained at constant level at other periods (when the M is not directly proportional to the distance from the tip end).

Although the linear inclination (constant of proportion) showing the distribution of bending moment M during downswing greatly varies according to time elapsed or players as hereinbefore mentioned, the direct proportionality between the bending moment M and the distance from the tip end 4 has been found to be maintained.

Therefore, the deflection radius of curvature ρ may be kept constant over the entire length at any temporal point or by any player so long as the distribution of the flexural rigidity EI is in direct proportion with the distance from the tip end 4. This is so even though the absolute value of deflection radius of curvature ρ varies for each temporal point and each player. Constant deflection radius of curvature ρ means that the shape of flex of the golf club shaft is roughly arcuate during downswing. The arcuate flex shows no kick point or partial change in the flex. Thus, a shaft which is universal and has a flexural feel may be obtained and will be widely accepted by a majority of players.

Based on the foregoing description, the shaft in accordance with the present invention shows the distribution of the flexural rigidity EI in which the flexural rigidity EI at each location is directly proportional to the distance from the tip end 4 of the shaft. The range showing the direct proportion extends for almost the entire length of the intermediate portion of the golf club shaft. That range does not include the reinforced tip portion and the gripping butt portion (numeral 3 in FIG. 2).

The reinforced tip portion is preferably the range from the tip end 4 to 300 mm toward the grip end 5. An EI value of this reinforced tip portion cannot be made as low as zero, since the golf head 6 is mounted to the tip end 4 and is used to hit the ball. Therefore, the reinforced tip portion is not included in the range of the distribution of the flexural rigidity EI in the "direct proportional relationship" of the present invention.

The gripping butt portion is also not included in the range of the distribution of the flexural rigidity EI in the "direct proportional relationship" of the present invention since the bending moment M in the vicinity of the grip end 5 greatly varies according to the grasping force of grip or other factors. The gripping butt portion is preferably the range from the grip end 5 to 100 mm toward the tip end 4.

The "direct proportional relationship" means that the flexural rigidity EI becomes 'almost zero' with X=0 when in the entire length of the intermediate portion, the graph of the distance X from the tip end 4 and the flexural rigidity EI at the position forms a primary profile (or with constant of proportion fixed) or a straight line and the line is extended toward the tip end of the shaft. In short, EI ($Nm^2$) satisfies $$EI=\alpha\cdot X \qquad \text{Equation 3}$$

where X (mm) is the distance from the tip end, and α is a given constant (See FIG. 18). α is preferably in the range of $0.015 \leqq \alpha \leqq 0.300$. α below 0.015 leads to excessive flexibility, which may impair the shaft function, and α more than 0.300 minimizes the quantity of flex during swing, which negates the meaning of the distribution of flexural radius of curvature. The deviation of α is within the range of ±0.003, which materializes the effect of the present invention.

As used herein, the phrase "in substantially direct proportion" means that the distribution of flexural rigidity EI satisfies the equation 3, with a deviation of α within the range of ±0.003. If the flexural rigidity of a EI of a point does not satisfy equation 3, within the given deviation limits, that point is not in "substantially direct proportion." In the present invention, the flexural rigidity and the distance from the tip end must be in substantially direct proportion generally over the length of the intermediate portion.

A preferred golf club shaft 1 comprises an intermediate portion except the portion 300 mm from the tip end 4 and the portion 100 mm from the grip end 5 and satisfies the equation 3 for 90% of the length of the intermediate portion. When the equation 3 is satisfied in the range at least 90%, the advantages of the present invention are realized.

The method to measure EI value in accordance with the present invention is now described below.

The golf club shaft 1 is supported only at the position 30 mm from the grip end 5, and a load of approximately 20 (N) is applied to the position 20 mm from the tip end 4 in the longitudinal axis or the direction vertical to the shaft axis. Then the movements (or deformation) of the shaft vertical to the axis are measured before and after the application of the weight at every 20 mm along the shaft axis from the supported end. The flexural profile is approximated to a circle by the least square method from the five neighboring points around each measured position. The radius of the circle is calculated to make it the radius of curvature ρ of the position. The bending moment M applied to each position may be obtained by multiplying the load by the distance to the weight position. The EI value of each position may be obtained by multiplying the radius of curvature ρ of the position by the bending moment M based on the abovementioned EI=ρM.

The present invention is now specifically described below by embodying it to the golf club shaft 1 of 3I (with the shaft length of 960 mm). For example, the golf club shafts 1 of the embodiments 1 through 3 shown in FIG. 18 satisfy the equation EI=α·X, where the flexural rigidity is EI ($Nm^2$), the distance from the tip end is X (mm), and α is a given constant (of proportion). The deviation of α is within α±0.003.

In the range satisfying the equation, the embodiments 1 through 3 show a rigid golf club shaft 1, a flexible golf club shaft 1, and a golf club shaft 1 having intermediate flexibility, respectively. The embodiments 1 through 3 satisfy EI=0.12X (Embodiment 1), EI=0.09X (Embodiment 2), and EI=0.06X (Embodiment 3) respectively, except for the reinforced tip portion (from the tip end 4 to the position 300 mm toward the grip end 5) and the gripping butt portion (from the grip end 5 to the position 100 mm toward the tip end 4).

It should be understood that these are just examples, and the value α may be changed according to the designed properties of the shaft as long as the value $\alpha$ is constant in the intermediate portion (typically, the range of X from 300 mm to 860 mm) and a virtual extension line which is formed by extending the linear part of the EI distribution graph toward the tip end of the shaft is directly proportional to the distance X and the flexural rigidity EI of that virtual extension line is 0 when the tip end X is 0. In practice, it is preferable that the value $\alpha$ comes within the range of $0.015 \leqq \alpha \leqq 0.300$.

Figure 18:
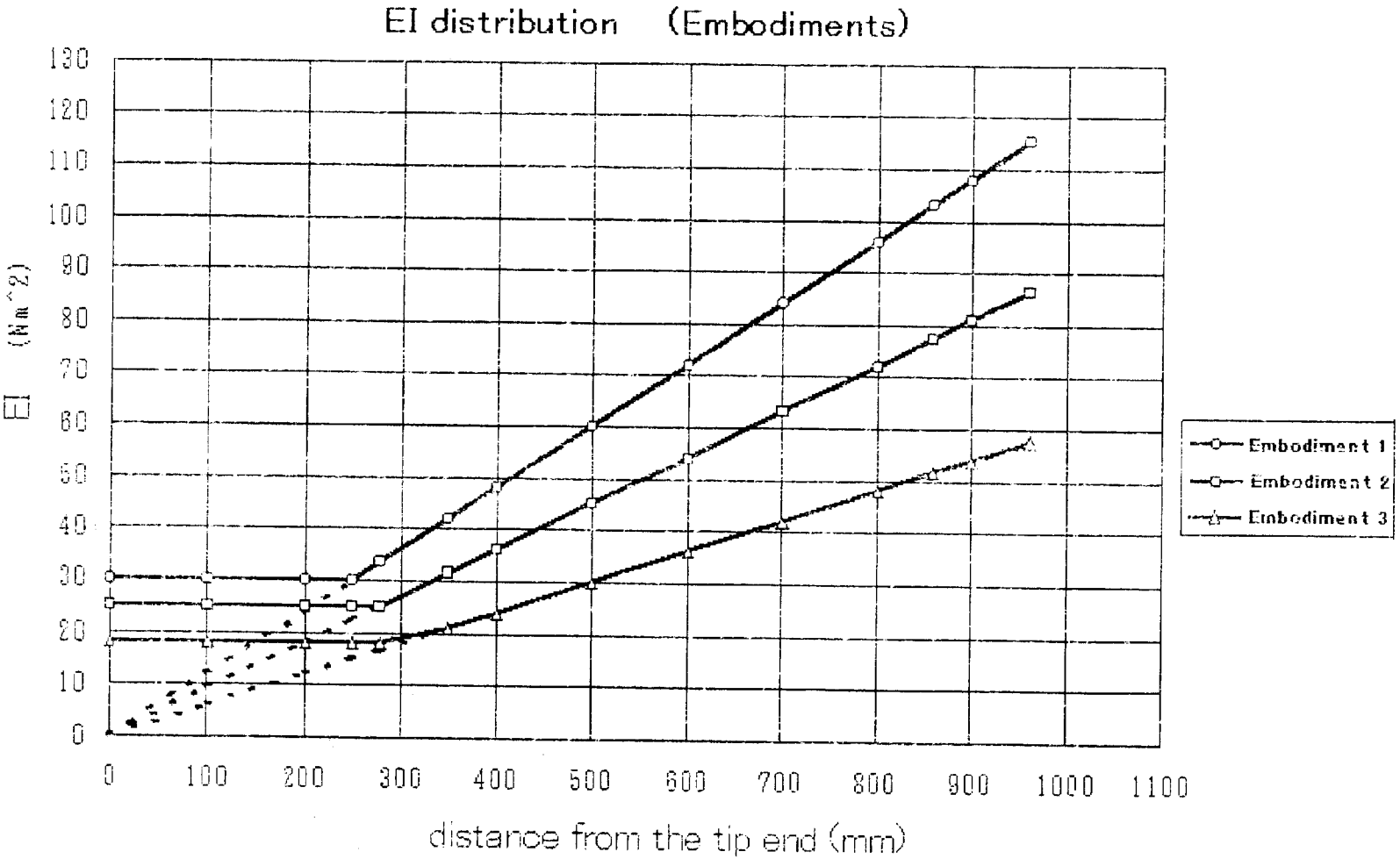
FIG. 18 is a graph showing the EI distribution of the golf club shaft in accordance with an embodiment of the present invention.
Figure 19:
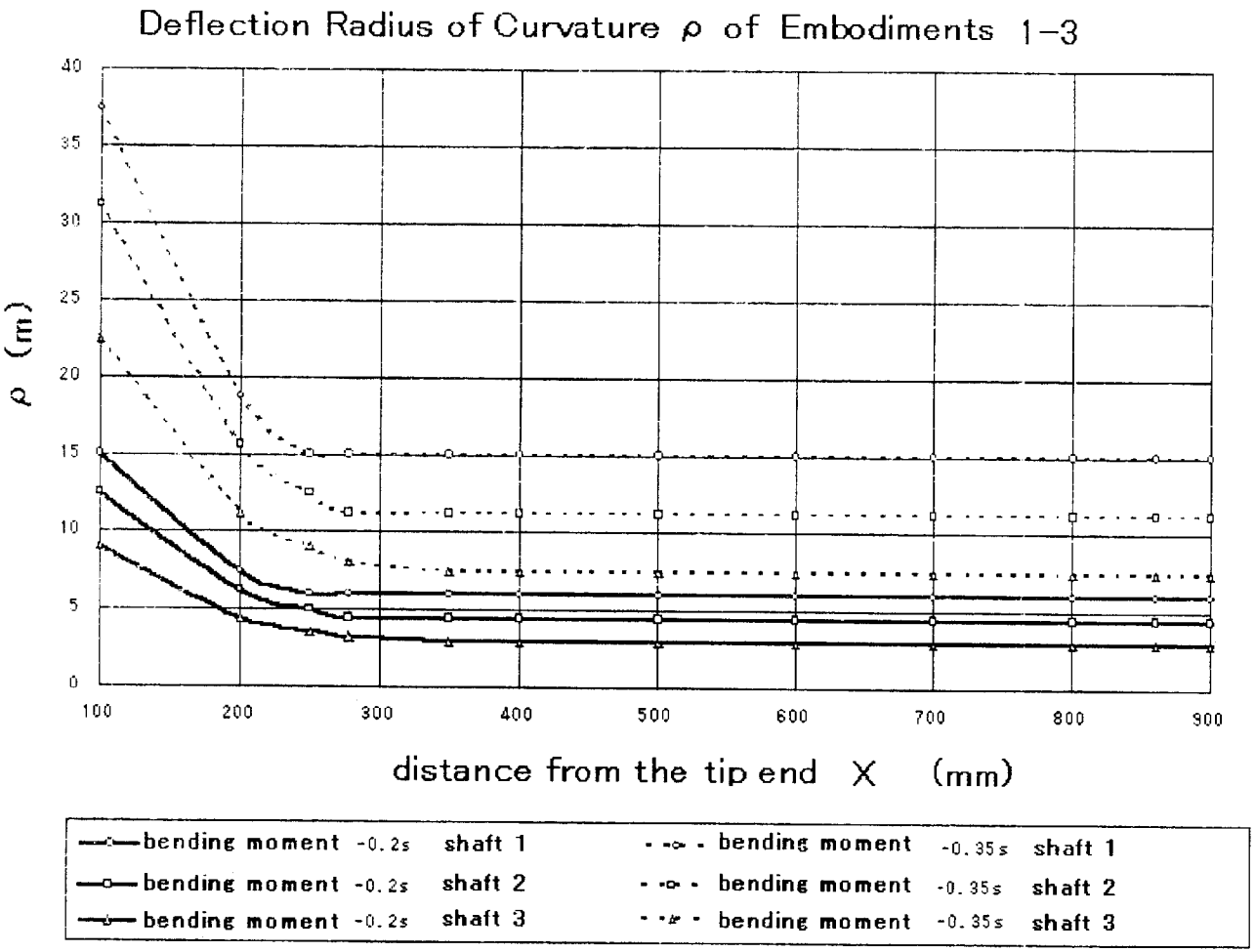
FIG. 19 is a graph showing the deflection radius of curvature of the golf club shaft when direct-proportion bending moment, in relation to distance from the tip end, is applied to the golf club shaft of FIG. 18 in accordance with the present invention.

The deflection radius of curvature $\rho$ (m) of the shaft, when the directly proportional bending moment M shown in FIG. 16 was added to the golf club shafts of Embodiments 1 through 3, may be obtained from the result of FIG. 18 and the equation 1. FIG. 19 is a graph showing their deflection radius of curvature $\rho$ (m). $\rho$ is constant in Embodiments 1 through 3 when X is from 300 mm to 960 mm.

As obvious from the foregoing description, the conventional shafts have deviations in the deflection radius of curvature $\rho$ at the important intermediate portion of the golf club shaft (See FIG. 17) and these deviations cause the subjects to feel a partial deflection difference. On the other hand, the embodiments having long portions that deflect constantly (See FIG. 19), cause no preference difference according to partial deflection difference. This allows these embodiments to be accepted by a majority of players.

While a comparison of FIG. 1 (Conventional shaft 1) with FIG. 18 (Embodiment 3) and FIG. 17 (Conventional shaft 2) with FIG. 19 (Embodiment 1) apparently shows similar EI distributions and similar deflections (or deflection radius of curvature $\rho$), they are greatly different in actual use.

It is not sufficient that the EI value is directly proportional to the distance from the tip end, but it is essential that a virtual extension line which is formed by extending the linear part of the EI distribution graph toward the tip end of the shaft is directly proportional to the distance X and the flexural rigidity EI is 0 when the tip end X is 0.

There are various methods to fabricate a golf club shaft having the EI distribution as described above, including a triaxial-braiding process, filament-winding process, and sheet-winding process.

In the triaxial-braiding process, tow prepreg obtained by impregnating continuous fiber tows as carbon fibers with resin is utilized to form triaxial braiding including central yarns arranged generally parallel to the longitudinal axis of the shaft and at an orientation angle of generally 0 degree and the right and left braid yarns disposed symmetrically at an angle of orientation against the shaft longitudinal axis. These three braid yarns are braided over the mandrel to form a shaft. In this process, the external and internal diameters of the shaft, or the cross sectional secondary moment I, are determined and the longitudinal elastic modulus E of the shaft is also determined by changing orientation angles of the right and left braid yarns. By adjusting the two values I and E, EI, which is product of cross sectional secondary moment I and elastic modulus E, can be made directly proportional to the distance from the tip end.

In the filament winding process, continuous fiber filaments are wound over the mandrel for shaft formation to form a shaft. In winding, the winding angle of the filaments may also be adjusted as in the triaxial braiding process.

In the sheet winding process, prepreg obtained by impregnating reinforcing fibers with resin matrix is cut to certain size and disposed so that the reinforcing fibers is placed at the specific angle or orientation, to form a shaft.

In a common sheet winding process, the internal diameter of the hollow shaft is simply uniformly tapered at the major portion, except the tip portion. The shaft thickness is also uniform. The cross sectional secondary moment I of the shaft is expressed by $$I=\pi/64\times\{(\text{external diameter})^4-(\text{internal diameter})^4\}.$$

Therefore, if the same material is used through the longitudinal axis, the EI value exponentially increases with the distance from the shaft tip end toward the butt portion. To correct this tendency, the longitudinal elastic modulus E of the shaft material is made lower toward the butt portion. The elastic modulus E may be decreased by using material of low elastic modulus at some portions. For example, highly elastic prepregs, in which the reinforcing fibers orient parallel to the longitudinal axis of the shaft, are cut in the middle of the longitudinal axis, and replaced with a reinforcing fiber prepregs with lower elastic modulus at the grip side. Thus the direct proportion may be attained between the flexural elasticity EI and the distance from the tip end.

The golf club shaft in accordance with the present invention is mounted to a head to form a golf club. It is preferable to mount the shaft to the head so that the tip end of the golf shaft falls within the range between the projection point obtained by perpendicularly projecting the center of gravity of the head onto the shaft axis and the position 50 mm from the projection point toward the grip side. This mounting position contributes to a golf club which effectively ensures the shaft performance in accordance with the present invention and has no 'kick point' which otherwise causes partial change in flex.

Figure 3:
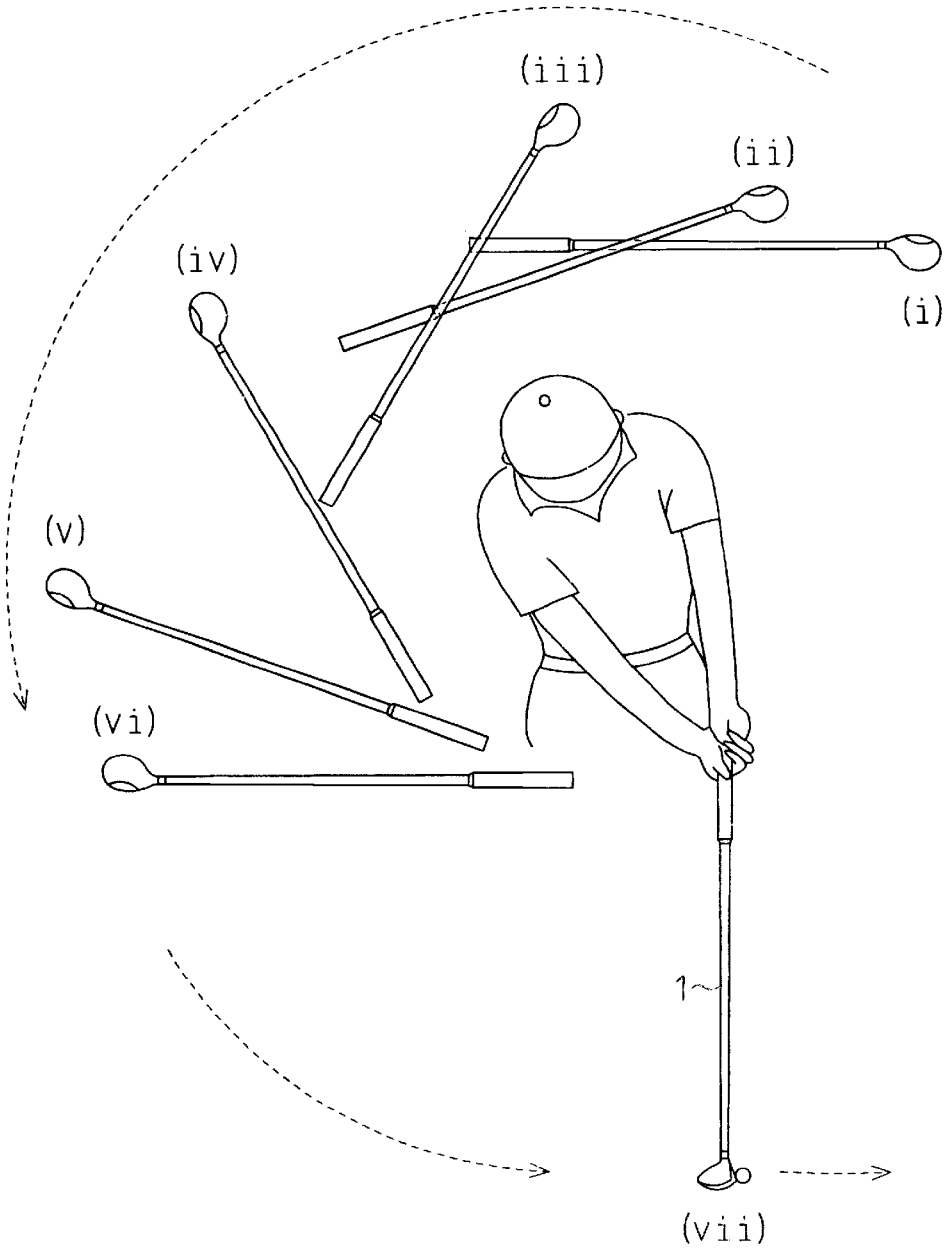
FIG. 3 is a conceptual diagram to show the golf club swing from head turn to the impact.
Figure 4:
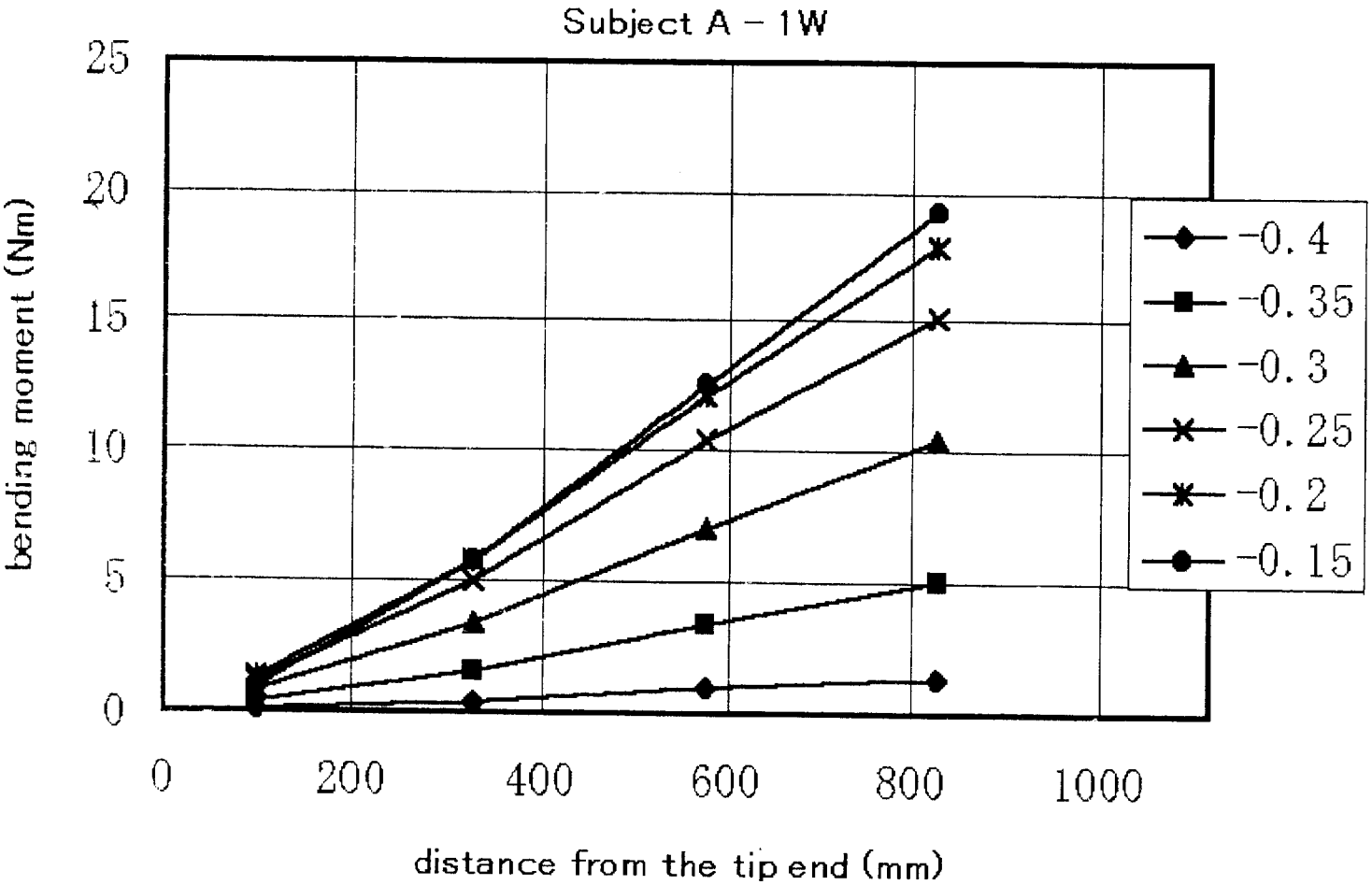
FIG. 4 is a graph showing the bending moment of the golf club shaft when a subject A swung a conventional No. 1 wood (1W).
Figure 5:
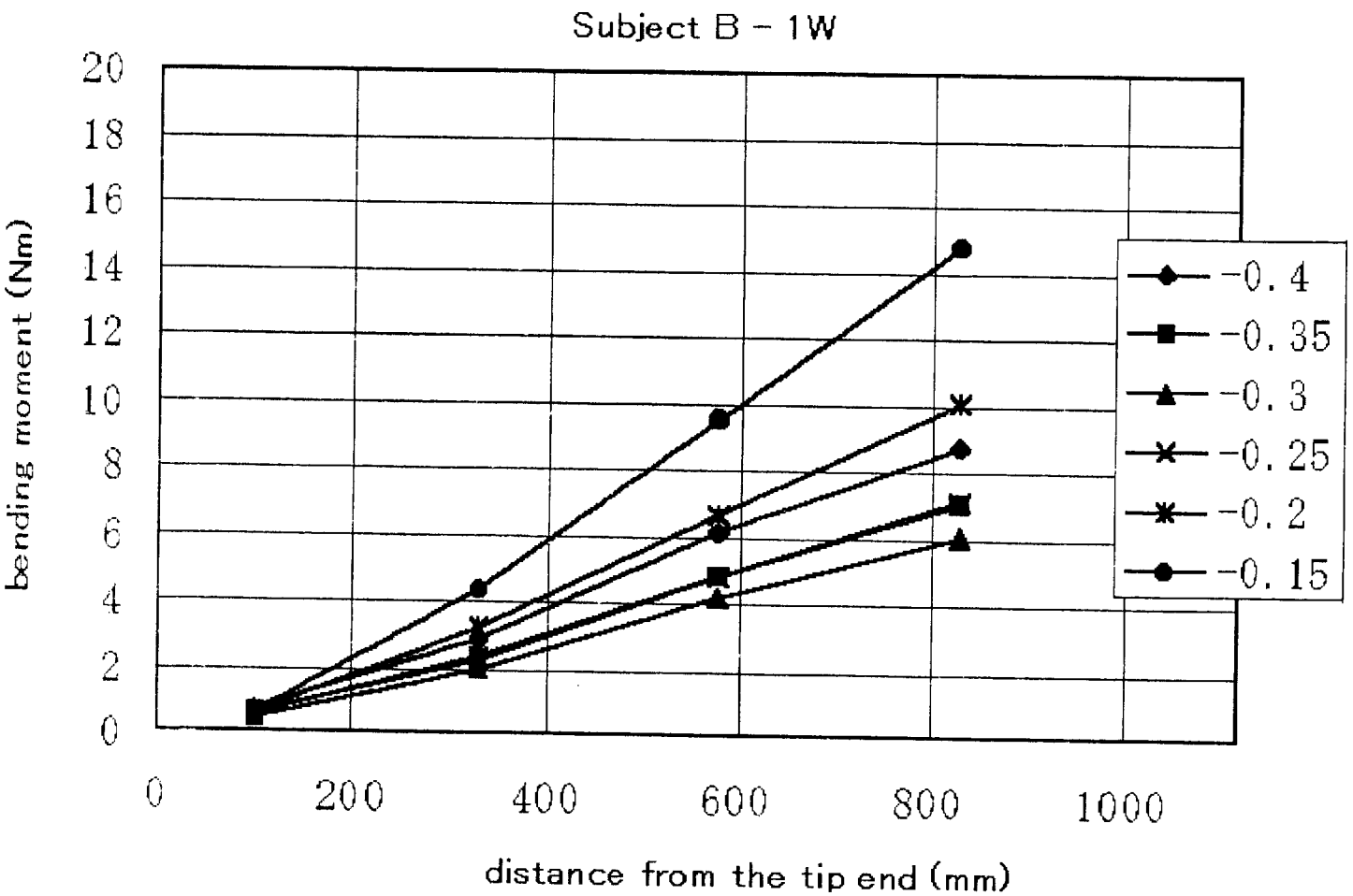
FIG. 5 is a graph showing the bending moment of the golf club shaft when a subject B swung a conventional No. 1 wood (1W).
Figure 6:
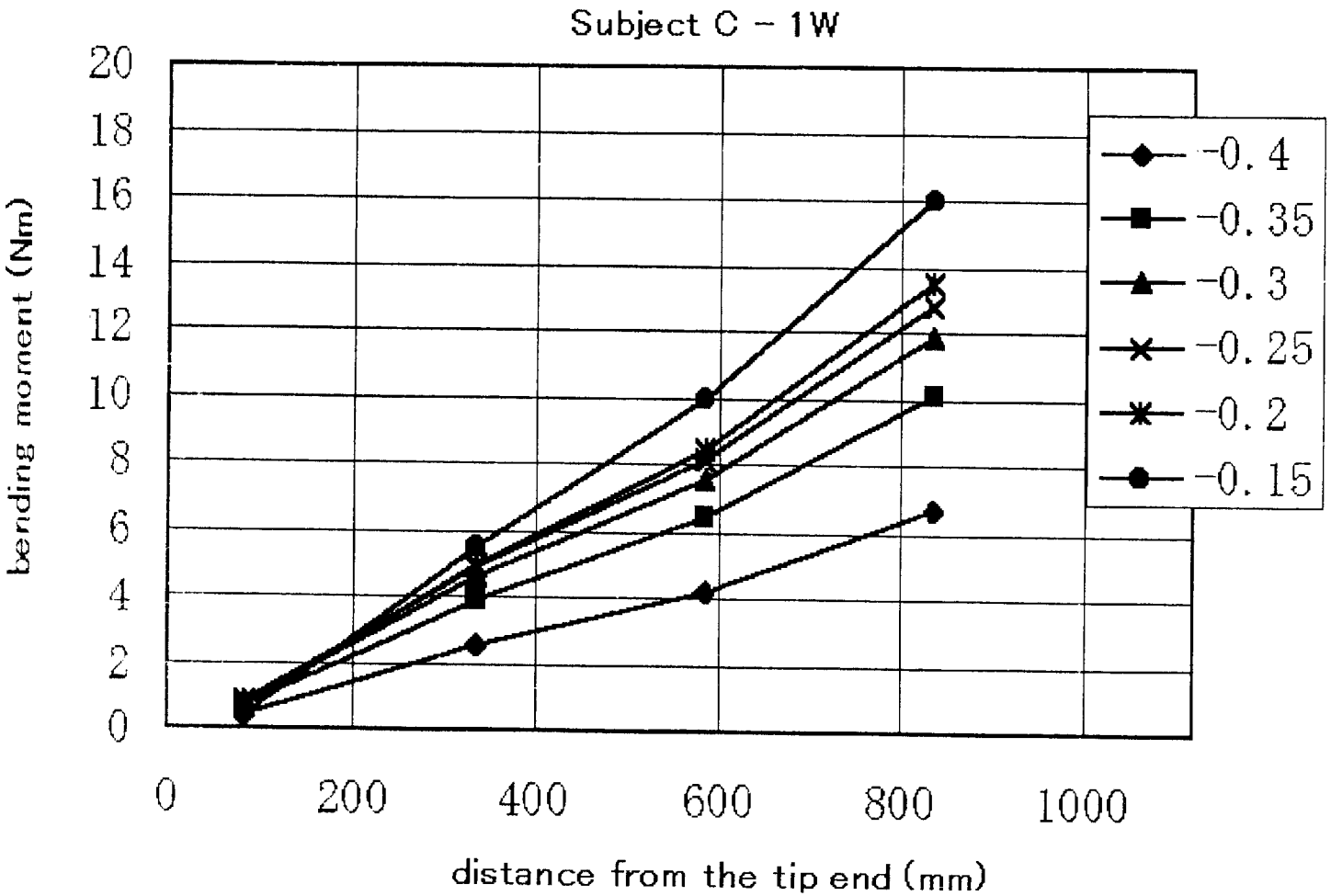
FIG. 6 is a graph showing the bending moment of the golf club shaft when a subject C swung a conventional No. 1 wood (1W).

Roughly directly proportional bending moment M is applied to a golf club shaft, since inertial force of the head mass is applied as a single concentrated load to the grip grasped by hands. The direction of the inertial force is determined by the going direction of the club during a swing. During downswing, the head advances in the direction diagonal to the shaft axis, as shown in FIG. 3. Thus, the inertial force on the center of gravity of the head is opposite to the going direction of the head. The point of action, where the inertial force is applied to the shaft, is located at an intersection of the vector of the inertial force applied to the center of gravity of the head and the shaft axis. The intersection falls within the range between the projection point obtained by perpendicularly projecting the center of gravity of the head onto the shaft axis and the position 50 mm from the projection point toward the grip side. Since the intersection slightly varies according to players or motion during a swing, it is essential to position the shaft tip end within that range.

If the shaft tip end is located far away from the center of gravity of the head (or more accurately, an intersection of the vector of the inertial force applied to the center of gravity of the head and the shaft axis), the bending moment applied to the shaft during downswing attains direct proportion against the distance from the portions other than the shaft tip end. In this case, the deflection radius of curvature $\rho$ of the shaft cannot be maintained constant during downswing.

Embodiments

Embodiment 1

An example of a golf club shaft fabricated with the triaxial braiding process is described. The shaft is used for a long iron that has the length of 1000 mm and weight of 100 g.

The shaft includes four layers, with the innermost layer designated as the first layer. The 12,000 carbon fibers with elastic modulus of 240 GPa, density of 1.8 g/cm$^3$ and fineness of 800 g/km are bundled to form a tow, and the tow is impregnated with epoxy to form a tow prepreg. The tow prepregs are braided as braid yarns to form the four layers. The first, third and fourth layers are braid layers, in which two symmetrical sets of eight yarns angled against the longitudinal axis, totaling 16 yarns, are braided. The second layer is a braid layer, in which a set of eight yarns extending at angle 0 degree against the longitudinal axis over the entire length and two symmetrical sets of eight yarns angled against the longitudinal axis, thus totaling 24 yarns, are braided.

The mandrel has an external diameter of 4.0 mm in the range between the tip end (0 mm) and 150 mm, 5.2 mm at the position 300 mm from the tip end, and 12.1 mm in the range between the 900 and 1200 mm from the tip end. The mandrel is tapered in the ranges between 150 and 300 mm from the tip end, and between 300 and 900 mm. Tow prepregs are braided in the abovementioned patterns over the mandrel.

The orientation angles of braid yarns against the longitudinal axis are detailed below. Two sets of eight braid yarns in the first layer gradually change from ±35 degrees to ±55 degrees from the tip end to the butt end. Two sets of eight braid yarns of the second layer gradually change from ±20 degrees to ±35 degrees from the tip end to the position 300 mm from the tip end and then change from ±35 degrees to ±50 degrees from the position 300 mm from the tip end to butt end. Two sets of eight braid yarns of the third and fourth layers gradually change from ±10 degrees to ±20 degrees from the tip end to the position 300 mm from the tip end and then change from ±20 degrees to ±10 degrees from the position 300 mm from the tip end to butt end.

After the braiding, the braid layers are pressurized by winding a wrapping tape in spiral pattern over the braid layers. Under such pressure, the braid layers are thermally cured. The layers are polished to form a shaft having a constant external diameter of 9.8 mm in the range between 0 and 160 mm from the tip end, another constant external diameter of 15.2 mm in the range between 900 and 1000 mm from the tip end and a tapered portion in the range between 160 and 900 mm from the tip end. Thus the EI distribution is set as 28.0 $Nm^2$ at the position 300 mm from the tip end, 84.0 $Nm^2$ at the position 900 mm from the tip end, and the flexural rigidity and the distance from the tip end are in substantially direct proportion therebetween.

Embodiment 2

An example of a golf club fabricated with the sheet winding process is described. The shaft is used for a driver that has the length of 1100 mm and weight of 50 g.

The mandrel has an external diameter of 6.3 mm at the tip end, 12.6 mm at the position 740 mm from the tip end, and 13.8 mm at the butt end. The mandrel is tapered in the ranges between 0 and 740 mm from the tip end and between 740 mm position and the butt end. Seven sheets of fiber-reinforced plastic prepregs formed of carbon fibers are wound over the mandrel. The innermost layer is designated as the first layer.

Among the seven sheets, only the innermost first layer is divided into two in the longitudinal direction, and different types of carbon fibers are used. That is, in the first layer, a prepreg sheet having carbon fibers with tensile elastic modulus of 400 GPa angled at 0 degree against the longitudinal axis is provided from the tip end (0 mm) to 700 mm, and another prepreg sheet having carbon fibers with tensile elastic modulus of 50 GPa also angled at 0 degree against the longitudinal axis is provided from the 700 mm position to the butt end. Both sheets are diagonally cut and abut together in order to prevent stress from concentrating at the 700-mm position and to ensure smooth transition of the flexural rigidity EI. The second layer is a prepreg sheet having carbon fibers with tensile elastic modulus of 460 GPa angled at +45 degrees against the longitudinal axis. The third layer is a prepreg sheet having carbon fibers with tensile elastic modulus of 460 GPa angled at −45 degrees against the longitudinal axis. The fourth layer is a prepreg sheet having carbon fibers with tensile elastic modulus of 400 GPa angled at 90 degrees against the longitudinal axis. The fifth, sixth, and seventh layers are prepreg sheets having carbon fibers with tensile elastic modulus of 240 GPa angled at 0 degree against the longitudinal axis. Additional prepregs are wound from the tip end to 300 mm from the tip end for reinforcement.

After the winding, the sheets are pressurized by winding a wrapping tape in spiral pattern over the sheets. Under such pressure, the sheets are thermally cured. Thus the EI distribution is set as 20.0 $Nm^2$ at the position 300 mm from the tip end, 66.6 $Nm^2$ at the position 900 mm from the tip end, and the flexural rigidity and the distance from the tip end are in substantially direct proportion therebetween.

Therefore, the present examples and embodiments are to be considered as illustrative and not restrictive and the invention is not to be limited to the details given herein, but may be modified within the scope and equivalence of the appended claims.

What is claimed is:

1. A golf club shaft, comprising:

a reinforced rip portion including a tip end;

a gripping bun portion including a grip end; and an intermediate portion between the reinforced tip portion and the gripping butt portion, wherein the intermediate portion satisfies an equation $EI=\alpha \cdot X$ generally over its entire length, where EI ($Nm^2$) is the flexural rigidity, X (mm) is the distance from the tip end of the shaft, $\alpha$ is a given constant, and the deviation of $\alpha$ is within the range of $\alpha$ 0.003;

wherein the deflection radius of curvature $\rho$ is constant over the entire length of the shaft except for the reinforced rip portion at any temporal point during downswing.

2. A golf club shaft set forth in claim 1, wherein the reinforced tip portion is the range from the tip end to the position 300 mm toward the grip end, and the gripping butt portion is the range from the grip end to the position 100 mm toward the tip end.

3. A golf club shaft set forth in claim 1, wherein the intermediate portion satisfies the equation for 90% of the entire length thereof.

4. A golf club shaft set forth in claim 1, wherein the intermediate portion satisfies the equation of claim 1 for at least 90% of the entire length thereof.

5. A golf club shaft set forth in claim 1, wherein the constant $\alpha$ falls within the range of $0.015 \leqq \alpha \leqq 0.3$.

6. A golf club shaft set forth in claim 1, wherein the golf club shaft is formed with a triaxial braiding process.

7. A golf club shift set forth in claim 1, wherein the golf club shaft is formed with a filament winding process.

8. A golf club set forth in claim 1, wherein the golf club shaft is formed with a sheet winding process.

9. A golf club comprising:

a shaft having a tin end and trip end, the shaft having a reinforced tip portion including a tip end;

a gripping butt portion including a grip end; and an intermediate portion between the reinforced tip portion and the gripping butt portion, wherein the intermediate portion satisfies an equation $EI=\alpha \cdot X$ generally over its entire length, where EI ($Nm^2$) is the flexural rigidity, X (mm) is the distance from the tip end of the shaft, $\alpha$ is a given constant, and the deviation of $\alpha$ is within the range of $\alpha \pm 0.003$;

wherein the deflection radius of curvature $\rho$ is constant over the entire length of the shaft except for the reinforced tip portion at any temporal point during downswing;

a head attached to the tip end of the shaft; and a grip attached to the grip end of the shaft;

wherein the head is attached to the shaft so that the tip end of the shaft falls within the range between the projection point obtained by perpendicularly projecting the center of gravity of the head onto the shaft axis and the position 50 mm from the projection point toward the arm side.

10. A golf club set forth in claim 9, wherein the reinforced tip portion is the range from the tip end to the position 300 mm toward the grip end, and the gripping butt portion is the range from the grip end to the position 100 mm toward the tip end.

11. A golf club set forth in claim 10, wherein the intermediate portion satisfies the equation for at least 90% of the entire length of the intermediate portion.

12. A golf club set forth in claim 9, wherein the intermediate portion satisfies the equation for at least 90% of the entire length of the intermediate portion.

13. A golf club set forth in claim 9, wherein the deflection radius of curvature $\rho$ is constant over the intermediate portion at any temporal point during downswing.

* * * * *